United States Patent [19]

Amaya et al.

[11] 4,396,927

[45] Aug. 2, 1983

[54] DIRECT IMAGING METHOD AND EQUIPMENT USING RECORDING ELECTRODE, MAGNETIC BRUSH, POWDERED TONER, AND INSULATING RECORDING MEANS

[75] Inventors: Mikio Amaya; Tetsurou Nakashima; Junzo Nakajima, all of Kawasaki, Japan

[73] Assignee: Fujitsu Limited, Kawasaki, Japan

[21] Appl. No.: 333,793

[22] Filed: Dec. 23, 1981

[30] Foreign Application Priority Data

Dec. 24, 1980 [JP] Japan ..... 55-183482
Apr. 30, 1981 [JP] Japan ..... 56-65529

[51] Int. Cl.[3] ..... G03G 15/08
[52] U.S. Cl. ..... 346/153.1; 118/657
[58] Field of Search ..... 346/153.1; 118/657

[56] References Cited

U.S. PATENT DOCUMENTS 4,218,691 8/1980 Fujii ..... 346/153.1
4,258,372 3/1981 Ishikawa ..... 346/153.1

*Primary Examiner*—John D. Welsh
*Attorney, Agent, or Firm*—Staas & Halsey

[57] ABSTRACT

A direct imaging method wherein a recording electrode comprising a plurality of electrode styli and a magnetic toner developer are provided on opposite sides of an insulating recording medium, such that an image is printed on the recording medium through direct adherence of magnetic toner on the recording medium when a voltage is applied across the recording electrode and magnetic toner developer. A proper gap discharge is generated between the recording electrode and the recording medium by forming a very narrow gap between the recording electrode and the recording medium. The present invention also comprehends adhering charges to the rear side of the recording medium by means of such gap discharge and the magnetic toner of the magnetic toner developer is reliably held to the surface of the recording medium by means of such charges.

22 Claims, 21 Drawing Figures

DIRECT IMAGING METHOD AND EQUIPMENT USING RECORDING ELECTRODE, MAGNETIC BRUSH, POWDERED TONER, AND INSULATING RECORDING MEANS

BACKGROUND OF THE INVENTION

This invention relates to electrostatic printing equipment for printing on a recording medium using stylus electrodes, and in more detail, to the so-called direct imaging method which simultaneously performs the latent image forming process and the developing process on a recording medium.

For years, the recording method known as the direct imaging method has been used, wherein the latent image forming process and the developing process were isolated. The structure and recording principle in this direct imaging method are explained in accordance with FIG. 1. The recording electrode 1, wherein a plurality of stylus electrodes are implanted, and the cylindrical back electrode 2 are provided face-to-face with a specified narrow gap between them. The recording medium sheet 3 contacts the recording electrode 1 in said narrow gap. Meanwhile, a conductive magnetic toner 5 is applied to the surface of the back electrode 2 by a magnetic field produced by a rotating magnet 4 and other means. The rotating magnet 4, the cylindrical back electrode 2, and the toner 5 form a magnetic brush forming means. The chip end of the magnetic brush, i.e., the toner 5, is placed in contact with the recording medium sheet 3. In this condition, a voltage corresponding to the image signal is supplied to said recording electrode 1 from the power supply 6 and the back electrode 2 is grounded in terms of voltage or receives a backward bias voltage. Charges are thereby imparted to the toner 5 which coats the recording medium 3 by being attracted by the electrical field of the recording electrode 1. Simultaneously, when the recording medium 3 is moved at a constant rate in the direction indicated by the arrow mark "a", the toner image corresponding to the image signal can be obtained on the surface of recording medium 3.

In the above-described existing technique, a direct recording medium using paper as the reocrding medium 3 is also known. This method is disclosed, for example, in U.S. Pat. No. 3,816,840. This method, is excellent for providing reduced size and simplified operation, but also has the following disadvantages.

(1) Since the resistance value of paper is as low as $10^{10}$ to $10^{11}$ ohms cm, the electrical field due to the recording electrode 1 spreads, therefore, not allowing the resolution to be increased.

(2) Since the dielectric coefficient of paper is as small as 1.2 to 2.5 and its capacity is also small, a high recording voltage is required.

(3) Recording quality may easily change due to a large influence of external humidity.

In order to compensate for the above-mentioned disadvantages, the paper thickness is reduced to 40 to 60 m, or special processing must be performed on the paper. Any of these measures inevitably restricts the kind and material of paper, and ordinary paper cannot be used.

Thus, the assignee of the present invention has disclosed in Japanese patent application Nos. 55-64840 and 55-64841, both laid open on Dec. 11, 1981, a method wherein an insulating film having a relatively high resistance of $10^{12}$ to $10^{16}$ ohms.cm is used and a toner image is formed thereon and then duplicated upon ordinary paper. The structure of recording equipment employing this method will now be explained using FIG. 2.

The recording medium 3, consisting of the insulating film formed like a belt, is rotated at a constant speed by the cylinders 8, 9 and 10. The recording electrode 1 is provided at the inside of this belt shaped recording medium 3 and is in close contact with it. In addition, the magnetic toner 5 which is transferred by the rotating magnetic roller 4 is prepared on the side facing the recording electrode 1 via the recording medium 3. The developing equipment 11 uses a back electrode 2 as the sleeve of the magnetic roller 4.

Now, in light of the method explained by reference to FIG. 1, after the toner image is formed on the recording medium 3, the recording medium 3 is rotated and the recording paper 12 is carried parallel to the recording medium 3 by the grounded cylinder 9, and said toner image is duplicated on the recording paper 12 from the rear side using the transfer corona 13 or a transfer roller. Thereafter, the toner image is fixed to the recording paper by means of the fixing roller 14. On the other hand, the recording medium 3 is further rotated and the remaining toner is removed, after the transfer of the image, by means of the cleaning blade 15, and collects in the toner retainer 20. The remaining charges due to the transfer operation of transfer corona 13 on the recording medium 3 are erased by the AC preclean corona 16, to allow repeated recording.

The recording system of this type is capable of using high resistance and high dielectric coefficient film as the recording medium 3 and, therefore, is capable of obtaining a comparatively high quality image from the point of view of resolution while using a low recording voltage. In addition, ordinary paper can also be used as the recording paper.

In this prior invention, the toner 5 is coated on the insulating film and the toner 5 is maintained by a fixing force or friction force. Resultingly, it is always accompanied by the following problem, that is, if the fixing force of the toner 5 is insufficient, the toner disappears from the film by means of the magnetic force of the rotating magnet 4. Moreover, as is described later, when executing a matrix drive between the recording electrode 1 and the back electrode 2, if the fixing force of toner is sufficient, the toner is fixed only with a low voltage, the toner is coated even at the half selected points and resultingly the printing quality is degraded. Moreover, when the resistance value of the toner 5 is low, if a voltage applied to the recording electrode 1 and the back electrode 2 is not continued while the recording medium 3 moves on the recording electrode 1, the charges imparted to the toner are lost and, resultingly, the toner cannot be fixed to the recording medium 3, thus making the matrix drive impossible.

SUMMARY OF THE INVENTION

It is an object of the present invention to provide a novel direct imaging method which sufficiently holds the toner so that it is not lost during the above-mentioned direct imaging method.

In order to attain this object, the present invention discloses a direct imaging method which provides a recording electrode opposite a magnetic brush forming means and a recording medium in between, for forming toner image on a first side of said recording medium by applying a voltage across said recording electrode and magnetic brush forming means while the chip end of the magnetic brush comes in contact with the first side of said recording medium through the powder toner of said magnetic brush forming means. A narrow air gap is kept between said recording electrode and said recording medium, and an air gap discharge is generated between said recording electrode and said recording medium by applying a voltage across said recording electrode and the magnetic brush forming means. The charges are fixed to the second side of said recording medium, and the powder toner of said magnetic brush forming means is held at the first side of said recording medium by means of said charges.

FIG. *7a* and FIG. *7b* are a vertical sectional view and a horizontal sectional view, respectively, of the recording electrode of another embodiment for effectuating the direct imaging method of the present invention.

FIG. *8a* and FIG. *8b* are a vertical sectional view and a horizontal sectional view, respectively, of the recording electrode of a further embodiment for executing the direct imaging method of the present invention.

Figure 9:
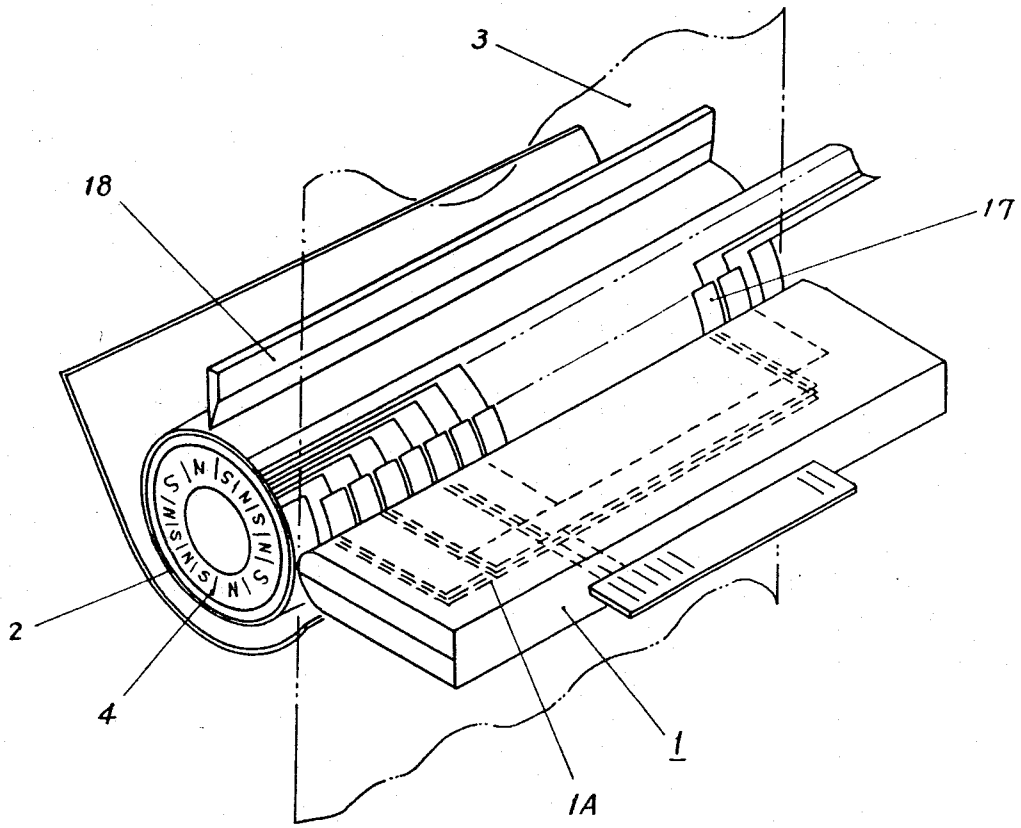

FIG. 9 is a perspective view indicating the structure of the image forming apparatus of another embodiment of the printing equipment adopting the direct imaging method of the present invention.

Figure 10:
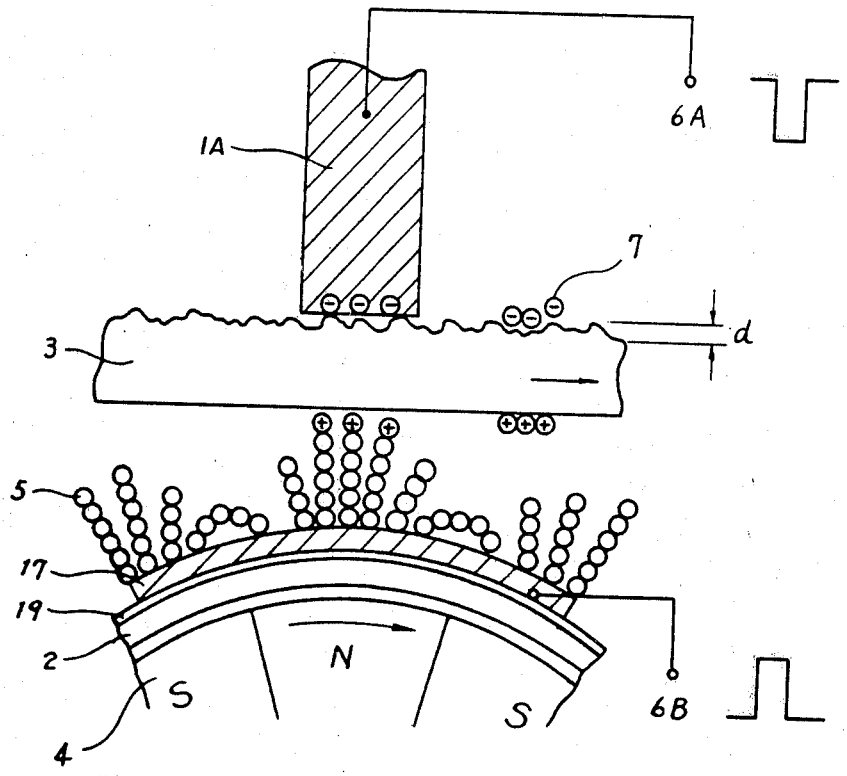

FIG. 10 is a partial sectional view of the structure of the image forming apparatus printing principle of the embodiment shown in FIG. 9.

Figure 11:
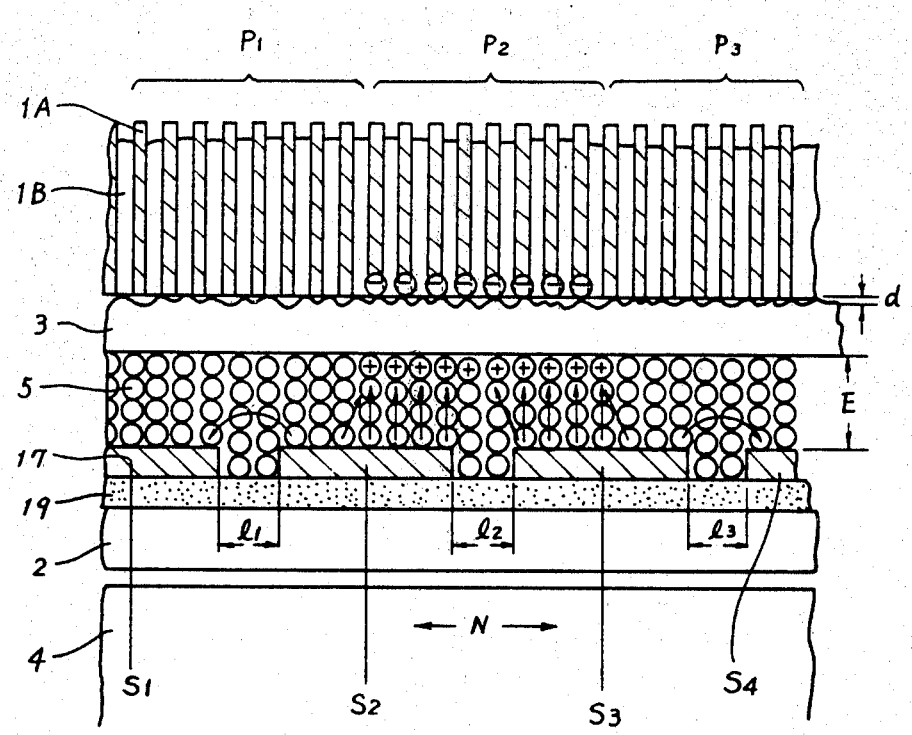

FIG. 11 is a horizontal sectional view of the image forming apparatus of the embodiment shown in FIG. 9.

Figure 12:
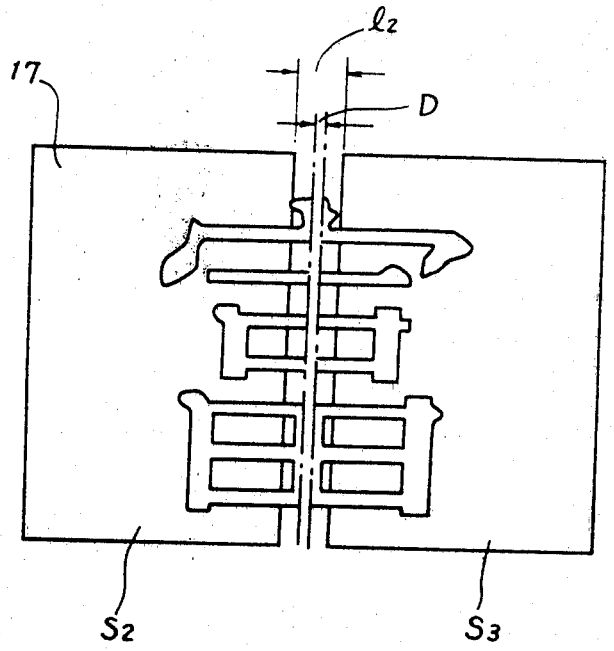

FIG. 12 illustrates the relation between the segmented back electrodes and the optical image in the embodiment shown in FIG. 9.

Figure 13:
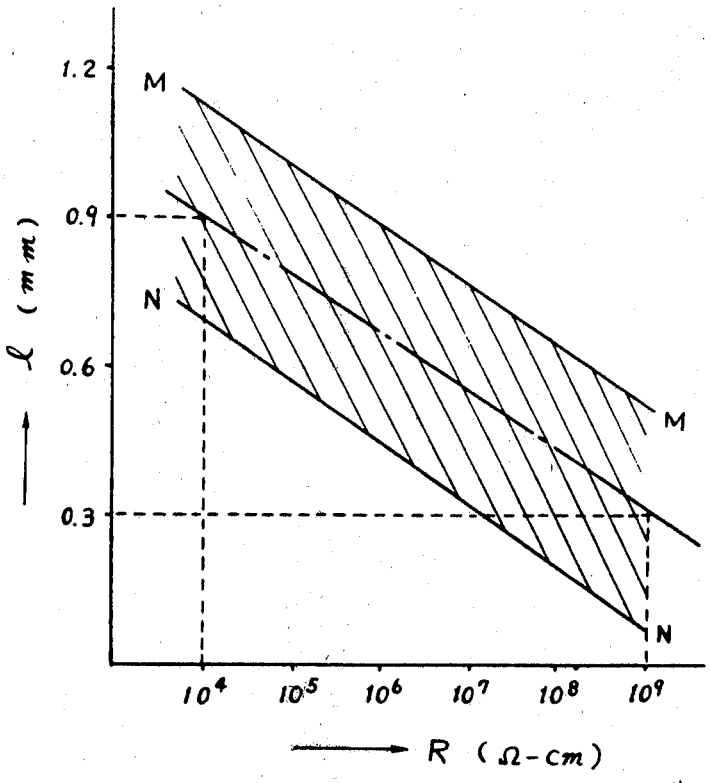

FIG. 13 is a graph indicating the relation between the interval of segmented back electrodes and the resistance value of magnetic toner in the embodiment shown in FIG. 9.

Figure 14:
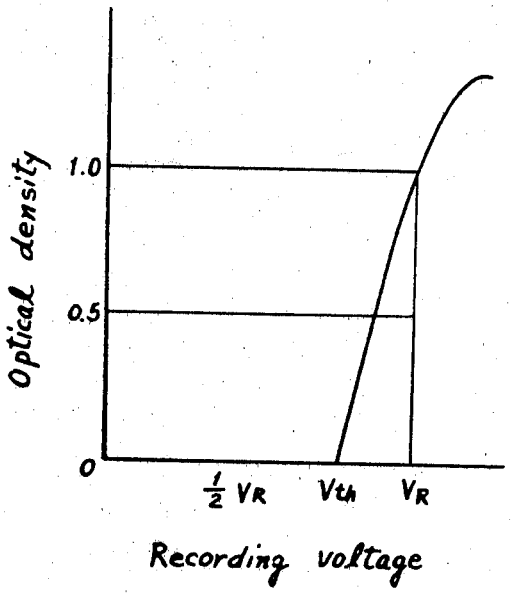

FIG. 14 is a graph indicating the relation between the recording voltage applied across the recording electrode and the segmented back electrodes and the optical density in the embodiment shown in FIG. 9.

Figure 15:
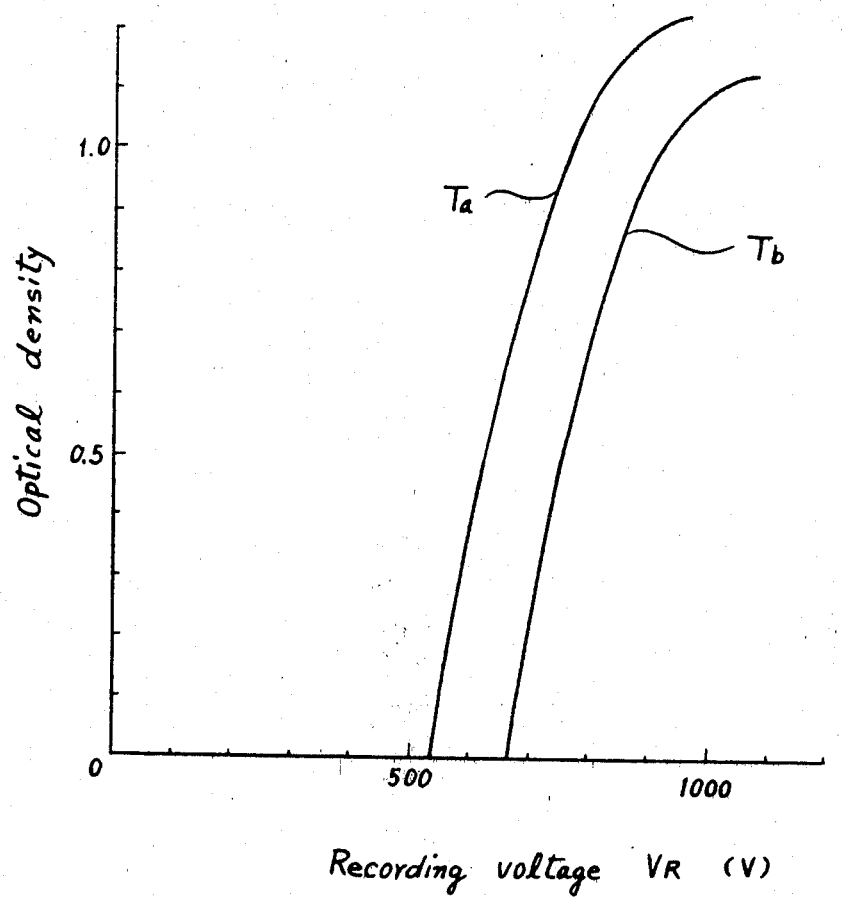

FIG. 15 is a graph indicating the relation between the recording voltage applied across the recording electrode and the segmented back electrodes and the optical density in the embodiment shown in FIG. 9.

Figure 16:
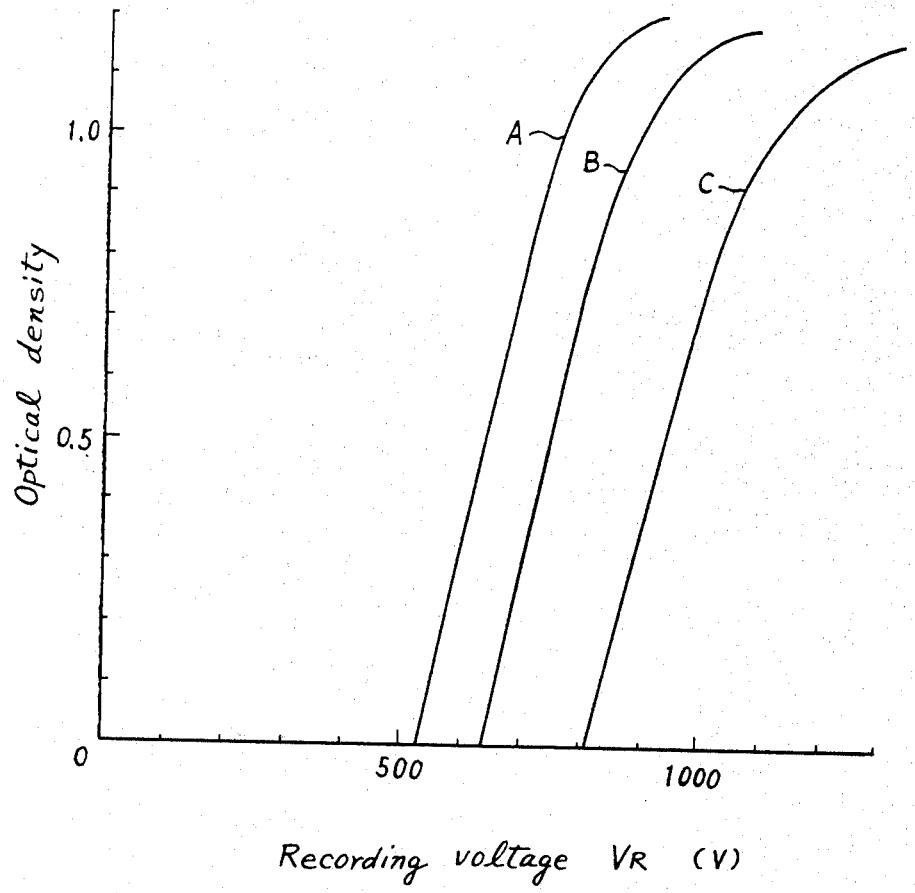

FIG. 16 is a graph indicating the relation between the resistance value of magnetic toner and the optical density in the embodiment shown in FIG. 9.

Figure 17:
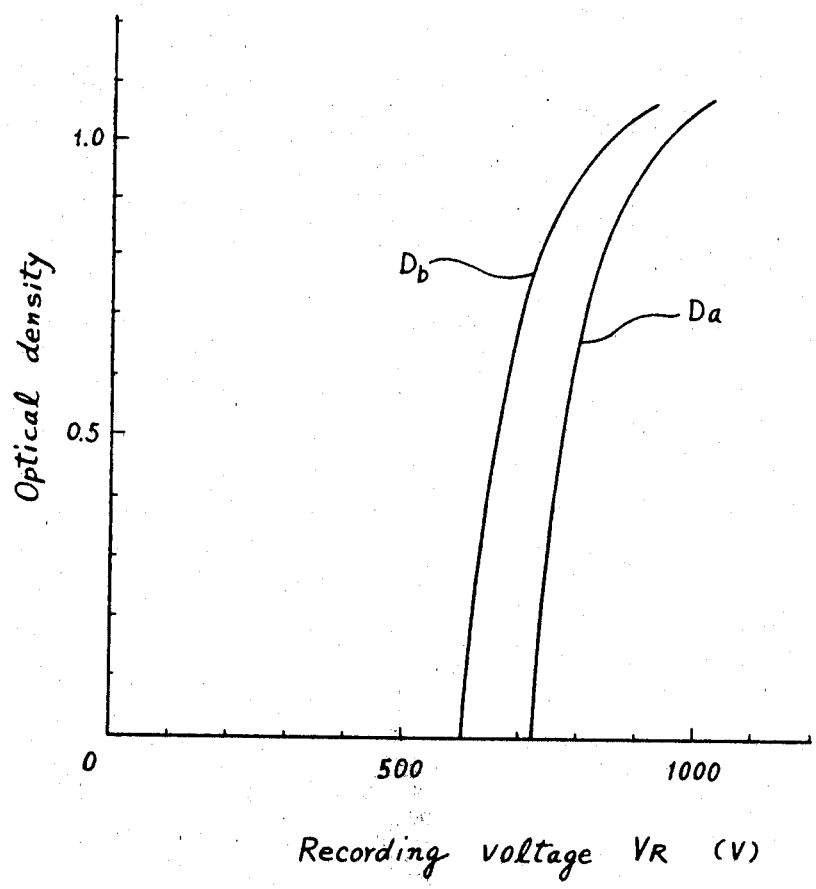

FIG. 17 is a graph indicating the relation between the thickness of the recording medium and the optical density in the present invention.

Figure 18:
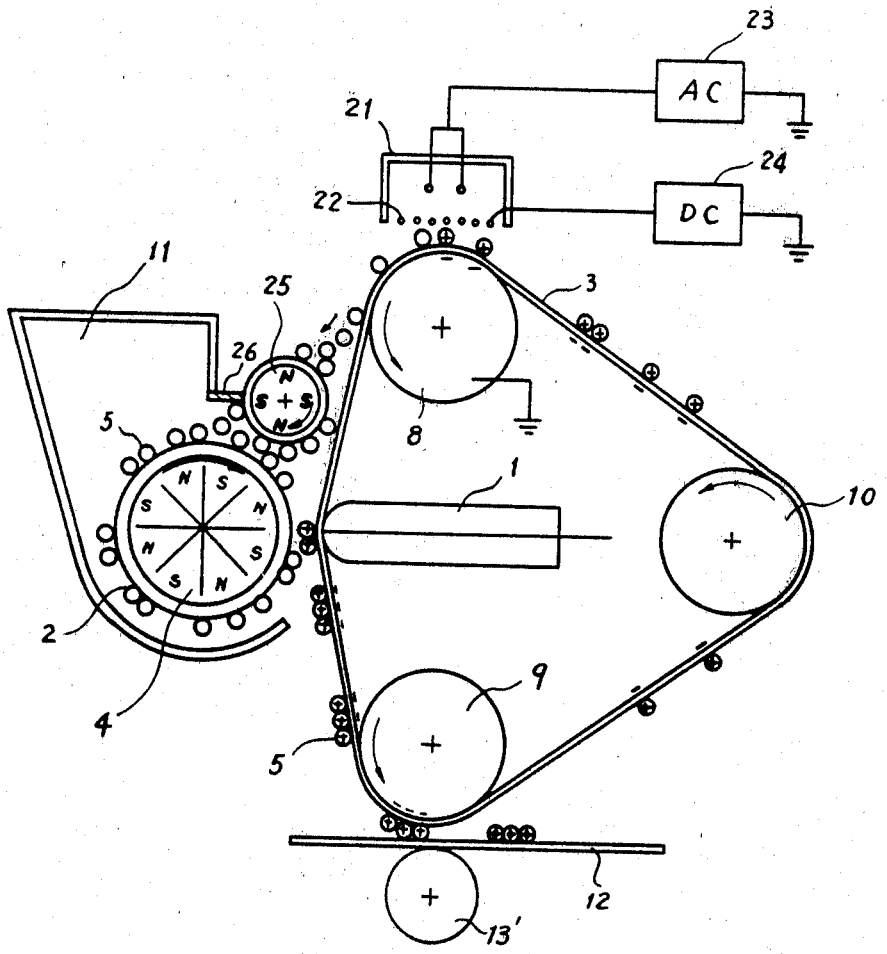

FIG. 18 is a sectional view of the entire recording apparatus of another embodiment using the direct imaging method of the present invention.

Figure 19:
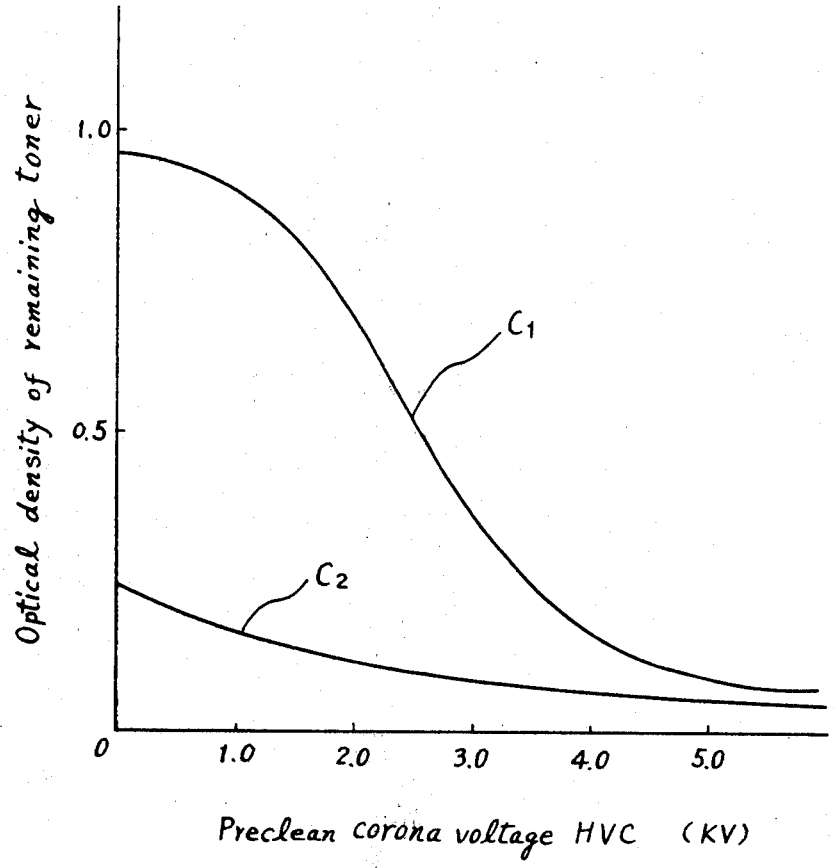

FIG. 19 is a graph indicating the relation between the preclean corona voltage and the optical density of remaining toner in the embodiment shown in FIG. 18.

DESCRIPTION OF THE PREFERRED EMBODIMENTS

The preferred embodiments of the present invention will be explained by referring to the attached drawings.

Figure 3:
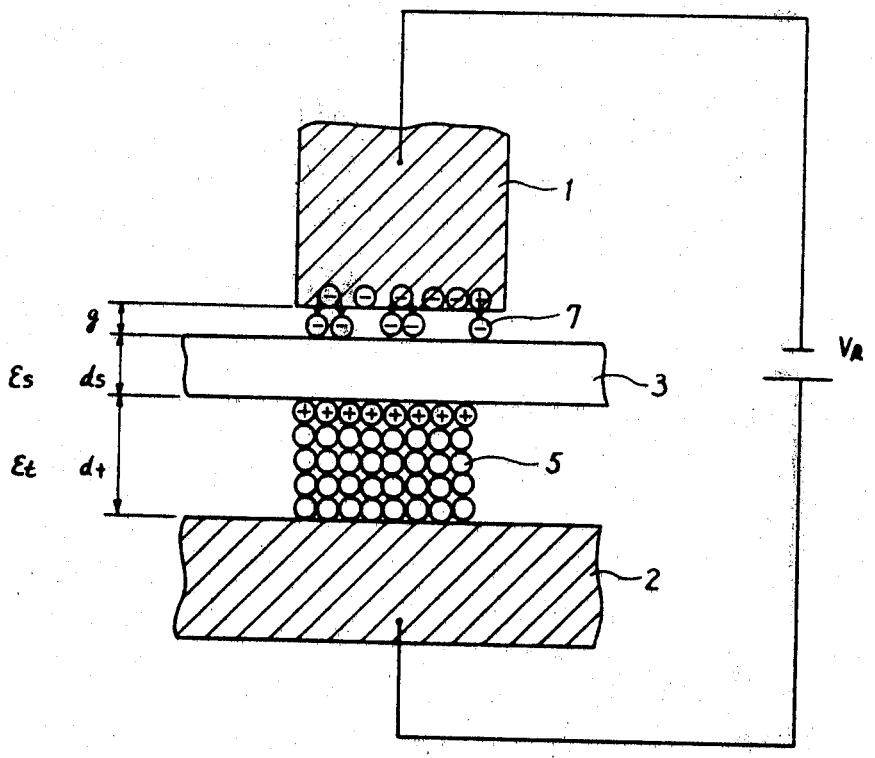
FIG. 3 illustrates the image forming apparatus of the present invention.

FIG. 3 illustrates the principle of the direct imaging method of the present invention.

In the present invention, investigation by the inventors of the use of an insulating film as a recording medium has provided the following useful invention.

Figure 1:
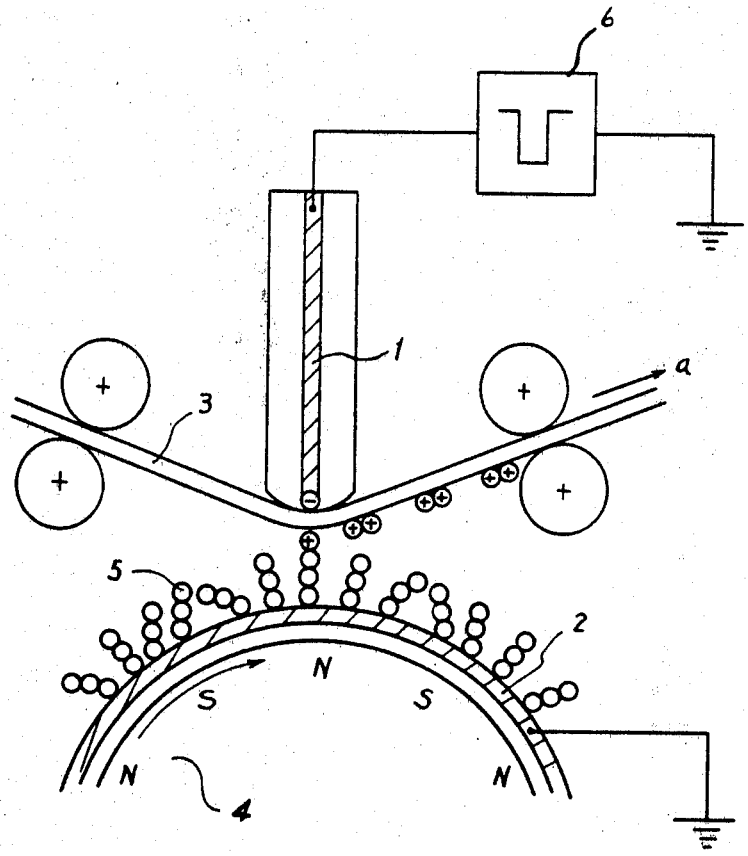
FIG. 1 (PRIOR ART)
FIG. 1 is a sectional view of the image forming apparatus of printing equipment adopting the existing direct imaging method.

A friction force or adhesive force as produced by the apparatus shown in FIG. 1 is insufficient for the toner to be fixed to the recording medium and carried, and therefore, reverse charges must necessarily be supplied from the recording electrode. If the reverse charge is not accumulated on the recording medium, the toner once adhered to the recording medium by the electrical field is returned to the back electrode by the magnetic field of the magnet and the mechanical self-cleaning effect of the toner after the printing pulse voltage disappears. Complete accumulation of reverse charges on the recording medium requires gap discharge between the recording medium and the recording electrode. When gap discharge occurs, the reverse charge within the recording electrode moves into the air gap and is accumulated on the recording medium. The principle of the present invention is explained by reference to FIG. 3.

In FIG. 3, when a voltage applied between the recording electrode 1 and back electrode 2 is $V_R$, the thickness and dielectric coefficient of the recording medium 3 and the toner layer 5 are, respectively, ds, dt, and $\epsilon_s$, $\epsilon_t$, and the gap distance between the recording electrode 1 and the recording medium 3 is g. The voltage $V_g$ applied on the gap can be obtained from the following equation.

$$V_g = V_R \cdot g/(dt/\epsilon_t + ds/\epsilon_s + g)$$

When this gap voltage $V_g$ exceeds the gap discharge voltage of Paschen, gap discharge occurs and charges 7 move and are adhered to the recording medium 3. The gap vs. breakdown voltage characteristic shown in FIG. 4 indicates the relation between the gap distance g and breakdown voltage $V_O$.

Figure 4:
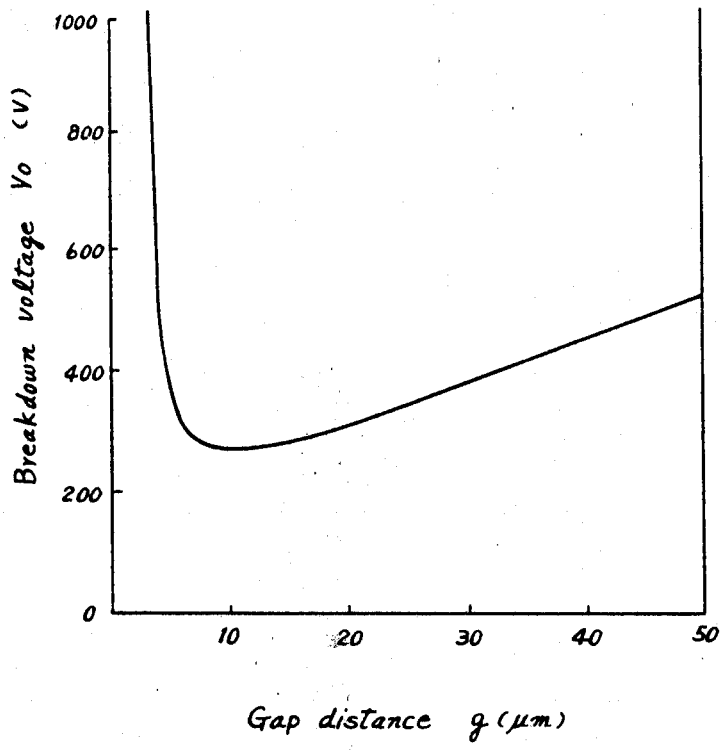
FIG. 4 is a graph indicating the relation between the gap distance and breakdown voltage.

As will be obvious from FIG. 4, an adequate gap distance g must be provided in order to create a discharge at a lower voltage $V_O$. Namely, the gap discharge is difficult to attain when the gap distance g is very narrow and the recording electrode 1 is placed close to recording medium 3.

An excessive gap also makes it difficult for gap discharge to occur. In other words, the gap distance g must be maintained within a range from 5 to 15 $\mu$m in order to best effectuate adequate gap discharge. Since such gap discharge has a threshold voltage (breakdown voltage), a matrix control drive, as explained later, is also possible.

The preferred embodiment of the present invention is explained hereunder.

On the basis of these useful findings, an embodiment of the present invention provides recesses and projections on the second side of the recording medium 3, i.e., the side in contact with the recording electrode 1, as a means for maintaining the gap distance g between said recording electrode 1 and the recording medium 3 a constant narrow distance while the recording medium 3 rotates. This configuration best effectuates stable gap discharge and makes image formation easy.

Figure 5:
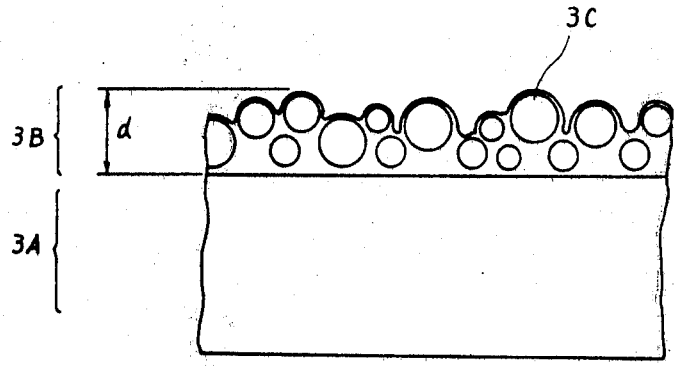
FIG. 5 is a sectional view of a recording medium for executing the direct imaging method of the present invention.

FIG. 5 shows the structure of the recording medium used in an embodiment of the present invention. The recording medium 3 is composed of the base material layer 3A and the uneven layer 3B. The base material layer 3A must be the insulating film, and desirably is a film having the resistance value of $10^{12}$ to $10^{16}$ ohms.cm. The base material layer consists of macromolecular materials such as polyester, polyethylene, polyvinyl chloride, ethylene tetrafluoride, polypropylene, etc. Thinner insulating film gives higher image resultion but the desirable thickness should be selected from the range of 16 to 50 μm, while considering the tensile strength of film formed into the belt shape. The uneven layer 3B is formed on the surface of such base material layer 3A by coating that which is obtained by mixing a powder 3C, e.g., a glass powder, calcium carbonate (average particle diameter of 8 to 15 μm), or a powder of thermally hardened resin, into an insulating resin such as unsaturated polyester, acryl or epoxy resin, and by isolating them by the doctor blading method or gravure coating method. When the dried-film thickness d is 5 to 15 μm, a recording medium 3 having an uneven surface suitable for gap discharge can be obtained. Otherwise, mechanically making the uneven surface of the base material layer 3A rough directly with the fillet or sand-blast method, can also be used to produce the recording medium 3.

Figure 6:
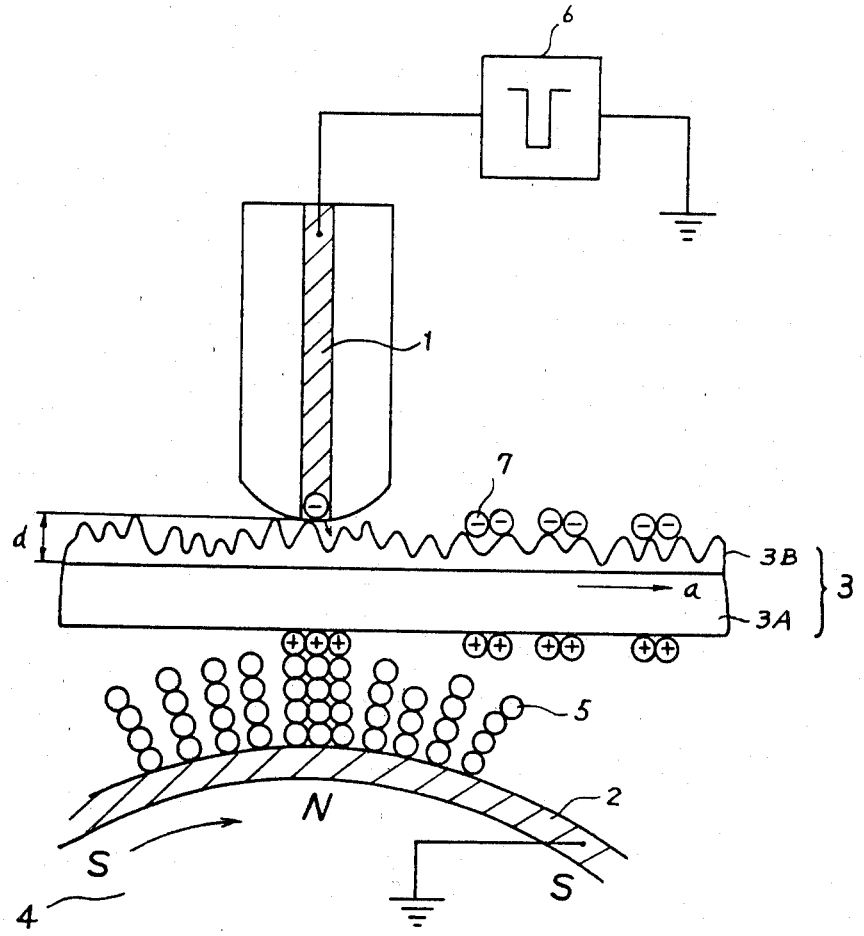
FIG. 6 is a sectional view of the structure of the image forming apparatus and the recording principle of the printing equipment to which the direct imaging method of the present invention is adopted.
Figure 7A:
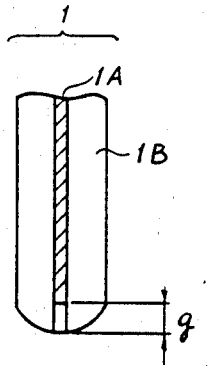
Figure 7B:
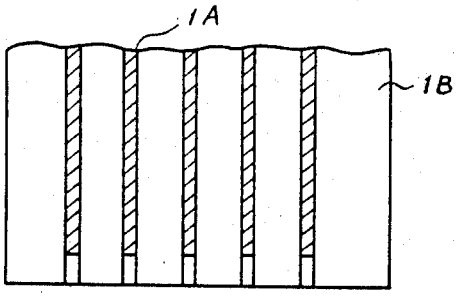

FIG. 6 is a sectional view of the structure of an embodiment of the present invention.

While the uneven side of recording medium 3, namely the uneven layer 3B, is in contact with the recording electrode 1, the recording medium 3 is moved at a constant speed in the direction indicated by the arrow marked "a" in FIG. 6. At this time, the toner 5 is held to the back electrode 2 by the method indicated in FIG. 1. When a voltage 6 is applied to the recording electrode 1 in accordance with the image signal, as explained in reference to FIG. 3, the gap discharge easily occurs at a lower recording voltage 6 since the adequate gap g is maintained. The opposite charges 7 are then fixed to the uneven surface 3B of the recording medium 3 as a result of being pulled by the toner 5 to which charges are also imparted. The recording voltage $V_R$ at this time is about 500 to 900 V for image formation, whereas the thickness of recording medium 3 is 16 to 50 μm.

As explained above, this embodiment provides a gap g with a more simple method by forming an uneven surface on the recording medium 3 and thereby allowing charges to be fixed by gap discharge, by effecting stable image formation with a low voltage, and by improving both performance and cost. Moreover, since the toner is coated to the recording medium by the gap discharge in the present invention, image formation is effected within a sufficiently short period of time, as compared with the time required when the recording medium moves on the recording electrode, and thereby the matrix recording explained later is possible.

Succeedingly, another embodiment of the present invention will be explained below.

In another embodiment of the present invention, a means is provided for always keeping the gap distance g between the recording electrode 1 and the recording medium 3 in FIG. 3 to a constant very narrow distance even while the recording medium 3 is being rotated. A level difference of only a very short distance is provided between the electrode stylus and the holding material at the chip end of the recording electrode 1. Thereby, when the recording electrode 1 and the recording medium 3 are placed in contact, the distance between the end point of the electrode stylus and the recording medium is held at a very narrow gap.

FIG. *7a* and FIG. *7b* show examples of the structure of the recording electrode used in another embodiment of the present invention. FIG. *7a* is a vertical sectional view, while FIG. *7b* is a horizontal sectional view.

The recording electrode 1 is composed of a plurality of electrode styli 1A arranged at equal intervals and fixed within a holding material. As the material for such electrode styli, copper wire, phosphor bronze wire or nickel wire, etc., can be used. As the material of holding material, an insulating and moldable resin or other epoxy, metacrylate, phenor or ethylene tetrafluoride resin can be used. Moreover, quartz powder, etc., may be mixed with them in order to increase strength.

As a method of giving uniform level difference to the distance of gap g between the end top of the holding material 1B and the end of the plurality of electrode styli 1A, the etching method is very effective, wherein the recording electrode 1 is dipped for a certain period into a solution for eroding part of the electrode styli 1A.

As an example, if an electrode stylus 1A is composed of phosphor bronze wire of 80 μm diameter, the electrode is washed after having been dipped for about 15 seconds into nitric acid solution. The end tops of the electrode styli are etched to a length of 10 μm to 12 μm, forming a cylindrical hole between the electrode and holding material 1B.

Figure 2:
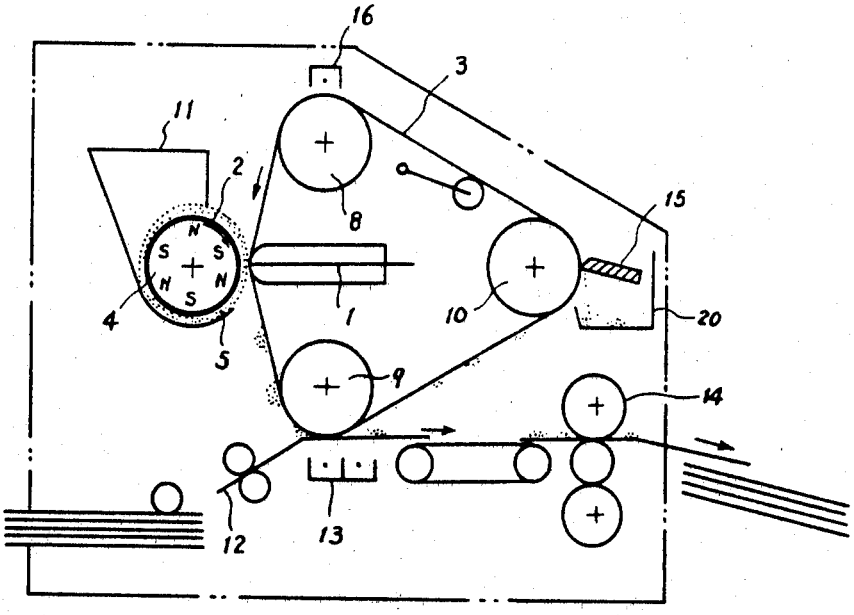
FIG. 2 shows an improved structure of printing equipment compared to the one shown in FIG. 1.

Thus, printing by the printing equipment shown in FIG. 2 utilizing the recording electrode 1 obtained as explained above results in excellent image formation when a voltage of 700 to 900 V is applied and polyester film having a thickness of 25 μm is used as the recording medium. Discharge easily occurs due to a constant gap g between the electrode styli 1A and the recording medium even if the recording electrode is placed closely to the recording medium 3.

Figure 8A:
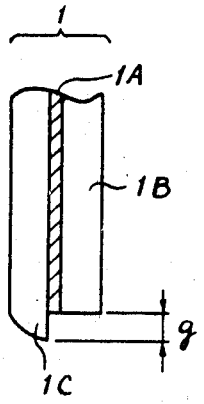
Figure 8B:
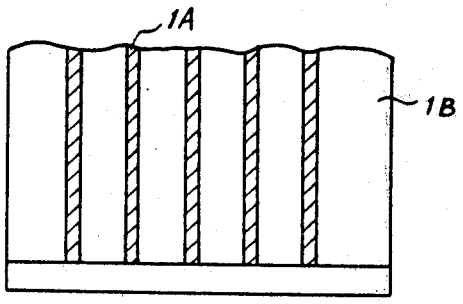

FIG. 8*a* and FIG. 8*b* show the structure of the recording electrode of another embodiment of the present invention. In this embodiment, as a method of maintaining the gap of the recording electrode stylus a level difference 1C between the electrode stylus 1A and the holding material 1B is provided by machining the end top of the recording electrode 1. FIG. 8*a* is the vertical sectional view while FIG. 8*b* is the horizontal sectional view. It is also possible to merely attach a piece having the thickness equal to the gap g after removing part of the electrode stylus 1A end top of recording electrode 1.

As explained above, this embodiment can hold the gap distance g using only a simple method of etching the end top of a recording electrode. This configuration also can produce stable image formation using only a low voltage, thus resulting in an excellent improvement of both the performance and the cost of the printing equipment shown in FIG. 2.

FIG. 9 is a perspective view of another embodiment adopting the present invention, particularly to the image forming part.

In FIG. 9, 1 is the recording electrode having an electrode stylus 1A consisting of a plurality of styli arranged in a line, and a voltage is applied to the electrode stylus 1A in accordance with the image signal after the recording medium 3, consisting of a dielectric film or ordinary paper is attached. The developer, consisting of the fixed cylindrical sleeve 2 and the magnetic roller 4 which rotates within the sleeve 2, is provided opposite the recording electrode 1 with the recording medium 3 in-between and the segmented back electrodes 17 are formed in the axial direction at the surface of sleeve 2.

At this point, FIG. 10 is referred to for further explanation. When the magnetic roller 4 rotates, the magnetic toner 5 is transferred from the segmented back electrodes 17 located on the insulator 19 to the recording medium 3, a voltage is applied in accordance with the image signal to the recording electrode 1A from the power supply 6A, a voltage of opposite polarity to that applied to the recording electrode 1A is selectively applied to the segmented back electrodes 17 from the power supply 6B, and the toner transferred on the selected segmented back electrode 17 is charged and thereby absorbed on the recording medium 3.

As similarly explained in regard to FIG. 3, the printing principle is as follows: discharge occurs because a voltage is applied across both the recording electrode and the segmented back electrode, the charges 7 of opposite polarity (negative charges in the case of FIG. 10) to that imparted to the magnetic toner 5 by applying a voltage to the segmented back electrodes 17 (positive charges in the case of FIG. 10), are coated on the second side of the recording medium 3 from the inside of the recording electrode 1A passing the gap d, the charged magnetic toner 5 is attracted to the first side of the recording medium 3 with a force stronger than the magnetic absorbing force of the magnetic roller 4, thus desired images can be formed on the recording medium 3.

The resistance value of magnetic toner used must provide a sufficient insulation to keep a voltage difference between the selected segmented back electrode 17 and the non-selected segmented back electrode 17. Actually, however, if the resistance value of the magnetic toner is too high for the gap width of the adjacent segmented back electrode, gaps are generated in the printed pattern, resulting in a defective print pattern, and moreover, if a resistance value of toner is too low, a leak phenomenon occurs between adjacent segmented back electrodes, thus forming no image.

In order to solve this problem, the present embodiment obtains a clear image by recognizing the relation between the interval of adjacent back electrodes 17 and the resistance value of magnetic toner.

This concept will now be explained using FIG. 11, FIG. 12 and FIG. 13.

The recording electrode stylus 1A is, as shown in FIG. 11, divided into groups $P_1$, $P_2$ and $P_3$ for matrix control, while the back electrode 17 is composed usually of the cylindrical sleeve 2 consisting of metal material and the flexible printed electrode using the insulator 19 as the base material adhered to the surface thereof. These back electrodes 17 are respectively divided and provided in parallel to the segmented back electrodes of $S_1$, $S_2$, $S_3$ and $S_4$.

To print on the group $P_1$ of the recording electrode stylus 1A, the segmented electrodes $S_1$ and $S_2$, located on both sides of gap $l_1$ of the back electrode 17 and which correspond to the group $P_1$ are driven simultaneously. Whereas, to print on the group $P_2$, $S_2$ and $S_3$ are driven simultaneously, and for group $P_3$, $S_3$ and $S_4$ are driven simultaneously. The operation for printing on the group $P_2$ of the recording electrode stylus 1A will now be explained in detail.

When a voltage is applied to the segmented electrodes $S_2$ and $S_3$ corresponding to the group $P_2$, charges are imparted to the magnetic toner 5 corresponding to the group $P_2$. At this time, a difference of width of gap at the center of the print pattern recorded is generated depending upon whether the charges are imparted quickly enough into the magnetic toner 5 existing at the gap $l_2$ between the segmented electrodes $S_2$ and $S_3$. Namely, as shown in FIG. 12, if the resistance value of magnetic toner 5 used is high, a gap D appearing on the print pattern extends almost up to the width of gap $l_2$ between the segmented electrodes $S_2$ and $S_3$ and an imperfect print portion occurs at the center of the print pattern. On the other hand, if the resistance value of magnetic toner 5 is low, the gap D on the print becomes more narrow. However, if the resistance value of the magnetic toner 5 is too low, as shown in FIG. 11, a resistance of gap $l_1$ in the segmented electrodes $S_2$ and $S_1$, and of gap $l_3$ in the electrodes $S_3$ and $S_4$, is also lowered and, therefore, a voltage applied to the segmented electrodes $S_2$ and $S_3$ leaks to the adjacent segmented electrodes $S_1$ and $S_4$, resulting in no printing. Thus, it is necessary to select a magnetic toner having an adequate resistance value R for the interval l between the segmented electrodes of back electrode 17.

FIG. 13 shows the results using an embodiment of the present invention wherein the relation between the interval gap l between the back electrodes and the resistance value R of magnetic toner is confirmed.

In the same figure, the resistance value R(ohm.cm) of magnetic toner is plotted on the horizontal axis, while the interval gap l (mm) between back electrodes is plotted on the vertical axis. The resistance value of magnetic toner shown in the figure is measured with a measuring electrical field of 3 KV/cm; the distance E between the segmented back electrode 17 and the recording medium 3 is 0.3 mm; the voltages applied to the segmented back electrode 17 and recording medium 3 are, respectively, +400 V, −400 V; and the recording medium 3 is composed of the insulating film in the thickness of 30 μm and having an uneven surface as previously discussed. In the hatched area between the parallel two straight lines M-M and N-N, a gap D at the center of the output print pattern is 0.1 mm or less and no leak is generated between the adjacent segmented back electrodes. As a result, it has been proved that when the gap between the segmented back electrodes is reduced to 0.3 mm from 0.9 mm, it is desirable that a resistance value of magnetic toner used increases to $10^9$ ohms.cm from $10^4$ ohms.cm.

From this result, the following modification also becomes possible. The hatched area of FIG. 13 can be shifted to the lower side by lowering the recording voltage or to the higher side by raising said recording voltage.

The reason a resistance value of magnetic toner is specified in the range from $10^3$ ohms.cm to $10^{11}$ ohms.cm is that if a resistance value of magnetic toner is higher than $10^{11}$ ohms.cm, charges cannot be imparted when the recording voltage is not very high, and if it is lower than $10^3$ ohms.cm, the leak between the segmented back electrodes is excessive and matrix control recording is no longer possible.

The relation between the recording voltage application method in the present invention and the amount of magnetic toner coated will be explained hereunder by referring to FIG. 14, FIG. 15, FIG. 16 and FIG. 17.

FIG. 14 is the graph indicating experimental results obtained by using the voltage application method of the present invention. The horizontal axis indicates the voltage (recording voltage) which is the sum of the voltage applied to the recording electrode 1 and the voltage applied to the segmented back electrode 17. The vertical axis indicates the optical density of the visible image formed by the magnetic toner coated to the recording medium 3. $V_{th}$ is the threshold voltage of discharge between the recording electrode 1 and the recording medium 3. The curve indicating optical density rises quickly and rapidly increases when the voltage applied exceeds the threshold value. Therefore, it has also been proved that the difference between the voltage $V_R$, which usually makes the optical density (O.D.) value 1.0 for the satisfactory optical density, and the breakdown voltage $V_{th}$, i.e., "$V_R-V_{th}$" can be made smaller than $\frac{1}{2}$ $V_R$. It is desirable that the value of "$V_R-V_{th}$" be small. The larger equivalent capacity of the recording medium 3 results in a smaller value of "$V_R-V_{th}$". Also, the smaller resistance value of the magnetic toner 5 results in a smaller value of "$V_R-V_{th}$".

When such condition is satisfied, if a voltage is smaller than $\frac{1}{2}$ $V_R$, even while it is applied to the recording electrode 1 and/or the segmented back electrode 17, it does not exceed the value $V_{th}$. Resultingly, discharge does not occur between the recording electrode 1 and the recording medium 3 and the toner 5 is not coated. Therefore, according to the embodiment of the present invention, a voltage which is equal to $\frac{1}{2}$ of the voltage $V_R$ and which assures sufficiently distinctive toner concentration is applied to the recording electrode 1, and the remaining voltage ($\frac{1}{2}$) is applied to the segmented back electrode 17. Thereby, excellent printing is carried out only when the voltages which are mutually of opposite polarity are applied to both recording electrode 1 and segmented back electrode 17. The toner is not absorbed when the voltage is applied only to one or the other electrode. Thus, half-selected control by the back electrode 17 becomes possible and simple, low cost and high quality direct imaging printing using a toner can be realized by adopting such control system into the matrix control drive system.

FIG. 15 is the graph indicating the relation between the application period of voltage (recording voltage) applied across both electrodes of the embodiment shown in FIG. 9 and the optical density. In this figure, the vertical axis indicates the optical density (O.D.), while the horizontal axis indicates the recording voltage $V_R$.

This data has been measured by changing the period of time for applying simultaneously the voltages to the recording electrode 1 and segmented back electrode 17 with the thickness of the recording medium being 25 μm, the moving rate is 5 cm/s, the developing distance is 0.2 mm and the resistance value of magnetic toner is $10^6$ ohms.cm.

In the same figure, $T_a$ is the data obtained using an application period of 1.6 ms, while $T_b$ is for the application period of 40 ms.

As is obvious from this data, a shorter application period results in lower optical density under the same recording voltage. Namely, when the voltage application period becomes shorter, the recording voltage must be greater in order to obtain the same recording density.

FIG. 16 is the graph indicating the relation between the recording voltage applied across both electrodes and the optical density in the embodiment shown in FIG. 9. In the same figure, the vertical axis indicates the optical density, O.D. while the horizontal axis indicates the recording voltage $V_R$.

This data indicates the optical density for the recording voltage $V_R$ when the thickness of the recording medium is 25 m, the developing distance is 0.2 mm and the recording period is 1.6 msec. In the same figure, the symbol A shows the characteristic when the magnetic toner having a resistance value of $10^6$ ohms.cm is used, while for B the toner having a resistance value of $10^9$ ohms.cm is used, and for C a toner having a resistance value of $10^{13}$ ohms.cm. As will be obvious from this data, when the resistance value of the magnetic toner is lower, the desired optical density can be obtained with a lower recording voltage.

FIG. 17 is the graph indicating the relation between the thickness of the recording medium and the optical density used for the present invention. In the same figure, the vertical axis indicates the optical density O.D., while the horizontal axis indicates the recording voltage $V_R$.

This data shows the relation between a voltage $V_R$ applied and the optical density of tao kins of recording media, each having different thickness when the application period of voltage applied across both electrodes is 40 ms, the developing distance is 0.2 mm and resistance value of magnetic toner $10^6$ ohms.cm. In the figure, symbol $D_a$ is the characteristic where the thickness of recording medium is 25 μm, while the symbol $D_b$ is the characteristic where thickness of the recording medium is 16 μm. From this data, it is understood that when the thickness of the recording medium is reduced, the specified optical density can be obtained with a lower recording voltage. However, if the recording medium is made too thin, the mechanical strength is also lowered. The desirable thickness of the recording medium should be selected within the range from 16 μm to 50 μm.

FIG. 18 shows a further embodiment of the present invention.

In this embodiment, the charges previously imparted to the remaining toner 5 are erased and the fixing force of the recording medium is reduced by additional modification to the structure shown in FIG. 2. Namely, the cleaner blade shown in FIG. 2 is omitted and corona radiation is carried out from above the remaining toner. The remaining toner is transferred to the developer on the recording medium, the remaining toner is re-collected into the developer by means of the developer roller or by the magnetic force of a collection roller, to be used for repeated recording. The same portions in FIG. 18 are all given the same numbering as in FIG. 2.

In this embodiment, the cleaning blade 15 and the toner retainer 20 used in FIG. 2 are no longer required and the remaining toner after transfer is carried under the preclean corona 21 by the recording medium 3. Here, the charges of the remaining magnetic toner and opposite charges coated to the inside of the recording medium 3 are erased by the corona radiation. For corona radiation, the DC power supply having a polarity opposite to the toner may be used, but the AC preclean corona using an AC power supply 23 shown in FIG. 18 is particularly effective. It is better for uniformly removing the charges of the magnetic toner to provide the grid wire 22 at the preclean corona 21 and to control the corona radiation so that toner charges become zero by means of the DC power supply 24. When the charges of the magnetic toner and the charges adhered to the second side of the recording medium 3 are erased, the force holding the toner to the recording medium 3 becomes almost zero. Therefore, the magnetic toner 5 is mechanically carried to the developer 11 while it is on the recording medium 3. Here, the remaining toner is collected on the developer 11 from the recording medium by means of a magnetic force produced by the developing roller 4 of the developer 11. For more effective collection, a collecting magnetic roller 25 is provided as shown in the figure and it is placed in contact with the recording medium 3 at the entrance side of the developing roller 4. If the magnetic force of the collecting magnetic roller 25 is sufficiently stronger than the force coating the toner to the recording medium 3, the toner is perfectly adhered to the collecting magnetic roller 25. The collecting magnetic roller 25 rotates and the wiping blade 26 contacts the surface of the collecting magnetic roller 25. Therefore, the adhered toner is wiped off by the wiping blade 26 and drops into the developer. Thus, the remaining toner can be collected. Using the collecting magnetic roller 25 is an embodiment of the present invention, but it is also possible to use a plate magnet or a magnetic roller with a sleeve.

According to this embodiment, not only is the cleaning efficiency of the recording medium 3 improved, but simplified, small and economical printing equipment can also be realized.

FIG. 19 is the graph indicating the relation between the preclean corona voltage and the optical density of remaining toner in the embodiment shown in FIG. 18.

In this figure, the vertical axis indicates the optical density (O.D.) of the remaining toner while the horizontal axis a voltage of AC power supply 23 applied to the preclean corona 21. This data is measured under the conditions that the magnetic force of the magnetic roller 4 is 850 gauss and the developing distance is 0.2 mm. In the figure, $C_1$ is the optical density of toner remaining on the recording medium after the toner image 5 formed on the recording medium 3 is directly discharged by the preclean corona 21 and then the remaining toner is collected by the developer 11. $C_2$ is the optical density of toner remaining on the recording medium, after the toner image formed on the recording medium 3 is transferred to the recording paper 12 by the transfer system 13 and discharged by the preclean corona 21 and finally collected by the developer 11. This data means that when the preclean corona voltage is increased, the optical density of the remaining toner becomes low both in the cases of $C_1$ and $C_2$ and much more remaining toner can be collected by the developer.

As explained above, according to the present invention, the application efficiency of magnetic toner reaches 100%, thus ensuring economical operation. The remaining toner can naturally be carried to the developer after the image transfer in accordance with rotation of the recording medium 1 and can be collected. In addition, the usual cleaning blade is no longer required so the system structure is simplified. Moreover, no excessive force is applied to the recording medium and thereby the operating life of the recording medium can be extended.

We claim:

1. A direct imaging method wherein the steps comprise: providing a recording electrode, a magnetic brush forming means having powder toner and an insulating recording medium with the recording electrode and magnetic brush forming means on opposite sides of the insulating recording medium for forming a toner image on the surface of said recording medium; contacting the end of the magnetic brush forming means with the surface of said recording medium through the powder toner of said magnetic brush forming means to form a toner image on the surface of said recording medium,; applying a voltage across said recording electrode and magnetic brush forming means while providing a very narrow gap between said recording electrode and said recording medium to generate a gap discharge between said recording electrode and said recording medium, wherein charges are adhered to the rear side of said recording medium opposite the recording electrode, and wherein the powder toner of said magnetic brush forming means is kept at the surface of said recording medium by means of said charges.

2. A direct imaging method as set forth in claim 1, wherein the magnetic brush forming means comprises a rotating magnetic roller, a fixed non-magnetic sleeve surrounding said magnetic roller, and a plurality of segmented back electrodes provided on the non-magnetic sleeve, and wherein the gap discharge is generated between said recording electrode and said recording medium by applying a voltage across said recording electrode and wherein the plurality of segmented back electrodes are selected, respectively; and charges are adhered to the rear side of the recording medium opposite said recording electrode.

3. A direct imaging method as set forth in claim 2, wherein the plurality of said segmented back electrodes are provided in parallel with a gap interval of 0.1 mm to 1.0 mm, and a resistance value of said magnetic toner used corresponding to such plurality of back electrodes is selected within the range from $10^{11}$ ohms.cm to $10^3$ ohms.cm.

4. A direct imaging method as set forth in claim 2, wherein the sum of voltages applied to the recording electrode and the plurality of segmented back electrodes has a value sufficient to cause discharge at the very narrow gap between said insulating recording medium and the recording electrode, and the voltage to be applied to said recording electrode and the plurality of segmented back electrodes is set so that no discharge occurs at said very narrow gap when a voltage is applied to either said recording electrode or the plurality of segmented back electrodes.

5. A direct imaging method as set forth in claim 1, wherein an endless belt type dielectric film is used as said recording medium.

6. Printing equipment comprising: a recording electrode, a magnetic brush forming means having magnetic toner, a magnetic toner developer for producing a magnetic force, an insulating recording medium and a recording paper, wherein the recording electrode and the magnetic brush forming means are provided on opposite sides of the insulating recording medium, a toner image is formed on the surface of said recording medium by applying a voltage across said recording electrode and the magnetic brush forming means while the end of the magnetic brush contacts the surface of said recording medium through the powder toner of said magnetic brush forming means, and said toner image is transferred to the recording paper, and wherein the charges of magnetic toner remaining on said recording medium are discharged after transfer of the image, when said magnetic toner is adhered to said recording medium by being succeedingly attracted by means of the magnetic force from said magnetic toner developer and thereby collected in the magnetic toner developer.

7. The printing equipment as set forth in claim 6, wherein said magnetic toner developer comprises: a developing roller and a collecting magnetic roller provided on the entrance side of said developing roller for collecting said magnetic toner into the magnetic toner developer by means of the magnetic force of said collecting magnetic roller.

8. A direct imaging method as set forth in claim 1, wherein said recording medium has an uneven surface facing said recording electrode in order to obtain a very narrow gap between said recording electrode and said recording medium.

9. A direct imaging method as set forth in claim 1, wherein said recording electrode is composed of an electrode stylus and holding material about the stylus for obtaining a very narrow gap between said recording electrode, wherein said recording medium and the end of said electrode stylus is recessed from the end of said holding material.

10. The printing equipment according to claim 6, wherein said magnetic brush forming means comprises: a rotating magnetic roller, a fixed non-magnetic sleeve surrounding said magnetic roller, and a plurality of segmented back electrodes provided on the non-magnetic sleeve.

11. A direct imaging method of claim 8, wherein the recording medium comprises:

(a) a base material layer made of insulating film selected from the group consisting essentially of polyester, polyethylene, polyvinyl chloride, ethylene tetrafluoride and polypropylene; and (b) an uneven layer formed on the surface of the base material layer selected from the group consisting essentially of glass powder, calcium, carbonate and a thermally hardened resin, mixed with a compound selected from the group consisting essentially of unsaturated polyester, acryl resin and epoxy resin.

12. A direct imaging method of claim 9, wherein the length of the recess is in the range of 10 μm to 12 μm.

13. A direct imaging method of claim 11, wherein the resistance of the base material layer is in the range of $10^{12}$ to $10^{16}$ ohms/cm.

14. A direct imaging method of claim 11, wherein the average diameter of the glass powder, calcium carbonate and a thermally hardened resin is in the range of 8–15 μm.

15. A direct imaging method of claim 11, wherein the thickness of the uneven layer is in the range of 5–15 μm.

16. A direct imaging method of claim 11, wherein the thickness of the recording medium is 16 μm. to 50 μm.

17. A recording medium to be used in printing equipment having a recording electrode, comprising:

(a) a base material layer made of insulating film and having a resistance in the range of $10^{12}$ to $10^{16}$ ohms/cm; and (b) an uneven layer formed on the surface of the base and having a thickness in the range of 5–15 μm.

18. A recording medium of claim 17, wherein the thickness of the recording medium is 16 μm to 50 μm.

19. A method for using printing equipment having at least a developer with a developing roller, a recording medium, and power toner, comprising the steps of:

(a) providing a preclean corona having a grid wire;

(b) moving the recording medium with powder toner thereon past the preclean corona;

(c) controlling the preclean corona radiation such that the toner charges become zero;

(d) providing a collecting magnetic means at the entrance side of the developing roller;

(e) contacting the recording medium with the collecting magnetic means;

(f) increasing the magnetic force of the collecting magnetic means to a value greater than the force coating the toner to the recording medium;

(g) moving the collecting magnetic means along a wiping blade; and (h) allowing the toner to drop into the developer.

20. The method of claim 19, wherein the collecting magnetic means is a magnetic roller.

21. The method of claim 19, wherein the collecting magnetic means is a plate magnet.

22. The method of claim 19, wherein the collecting magnetic means is a magnetic roller with a sleeve.

* * * * *

UNITED STATES PATENT AND TRADEMARK OFFICE

CERTIFICATE OF CORRECTION

PATENT NO. : 4,396,927

DATED : August 2, 1983

INVENTOR(S) : MIKIO AMAYA et al.

It is certified that error appears in the above-identified patent and that said Letters Patent is hereby corrected as shown below:

Col. 1, line 44, change "reocrding" to --recording--;
line 50, change "ohms cm" to --ohms·cm--;
line 60, change "m" to --μm--.

Col. 3, line 46, after "apparatus" insert --employing the--.

Col. 8, line 3, change "1" to --$\ell$--;
line 17, change "$1_2$" to --$\ell_1$--;
line 20, change "$1_2$" to --$\ell_2$--;
line 27, change "$1_1$" to --$\ell_2$--;
line 28, change "$1_3$" to --$\ell_1$--;
line 33, change "1" to --$\ell_3$--;
line 37, change "1" to --$\ell$--;
line 41, change "1" to --$\ell$--.

Col. 10, line 14, change "25m" to --25μm--;
line 31, change "tao kins" to --two kinds--.

UNITED STATES PATENT AND TRADEMARK OFFICE

CERTIFICATE OF CORRECTION

PATENT NO. : 4,396,927

DATED : August 2, 1983

INVENTOR(S) : MIKIO AMAYA et al.

It is certified that error appears in the above-identified patent and that said Letters Patent is hereby corrected as shown below:

Col. 11, line 41, after "axis" insert --indicates--.

Col 12, line 14, delete the comma ",".

Col. 14, line 5, change "ohms/cm" to --ohms'cm--;
line 18, change "ohms/cm" to --ohms'cm--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*